US011339451B2

(12) United States Patent
Xue et al.

(10) Patent No.: US 11,339,451 B2
(45) Date of Patent: May 24, 2022

(54) LOW-COST AND HIGH-FORMABILITY 1180 MPA GRADE COLD-ROLLED ANNEALED DUAL-PHASE STEEL PLATE AND MANUFACTURING METHOD THEREOF

(71) Applicant: BAOSHAN IRON & STEEL CO., LTD., Shanghai (CN)

(72) Inventors: Peng Xue, Shanghai (CN); Xiaodong Zhu, Shanghai (CN); Wei Li, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 190 days.

(21) Appl. No.: 16/624,270

(22) PCT Filed: Jun. 26, 2018

(86) PCT No.: PCT/CN2018/092876
§ 371 (c)(1),
(2) Date: Dec. 18, 2019

(87) PCT Pub. No.: WO2019/001423
PCT Pub. Date: Jan. 3, 2019

(65) Prior Publication Data

US 2020/0115769 A1 Apr. 16, 2020

(30) Foreign Application Priority Data

Jun. 30, 2017 (CN) ..... 201710520183.3

(51) Int. Cl.

| | |
|---|---|
| ***C21D 9/00*** | (2006.01) |
| ***C22C 38/04*** | (2006.01) |
| ***C21D 8/02*** | (2006.01) |
| ***C22C 38/02*** | (2006.01) |
| ***C22C 38/06*** | (2006.01) |
| ***C22C 38/12*** | (2006.01) |
| ***C22C 38/14*** | (2006.01) |

(52) U.S. Cl.
CPC ..... *C21D 8/0236* (2013.01); *C21D 8/0215* (2013.01); *C21D 8/0226* (2013.01); *C21D 8/0273* (2013.01); *C21D 9/0062* (2013.01); *C22C 38/02* (2013.01); *C22C 38/04* (2013.01); *C22C 38/06* (2013.01); *C22C 38/12* (2013.01); *C22C 38/14* (2013.01); *C21D 2211/005* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 2012/0138194 | A1* | 6/2012 | Sun | B32B 15/013 148/400 |
| 2017/0137906 | A1 | 5/2017 | Fan et al. | |
| 2018/0237881 | A1* | 8/2018 | Okamoto | C22C 38/14 |

FOREIGN PATENT DOCUMENTS

| | | | | |
|---|---|---|---|---|
| CN | 1809649 | A | | 7/2006 |
| CN | 102227511 | B | | 10/2011 |
| CN | 102828106 | A | | 12/2012 |
| CN | 103930585 | A | | 7/2014 |
| CN | 105829564 | A | | 8/2016 |
| CN | 106661653 | A | | 5/2017 |
| CN | 106661701 | A | | 5/2017 |
| JP | H06-271942 | A | | 9/1994 |
| JP | 2006052458 | A | | 2/2006 |
| JP | 2017053009 | A | * | 3/2017 |
| KR | 10-2011-0067159 | A | | 6/2011 |
| KR | 10-2016-0098381 | A | | 8/2016 |
| WO | 2016129213 | A1 | | 8/2016 |

OTHER PUBLICATIONS

International Search Report for related International Application No. PCT/CN2018/092876, dated Aug. 23, 2018; English translation of ISR provided (6 pages).
Office Action for related Chinese Application No. 201710520183.3 dated Mar. 25, 2020 (6 pages).
Extended European Search Report for related U.S. Appl. No. 18/825,106 dated Feb. 1, 2021 (11 pages).
Office Action for related Japanese Application No. 2019-568097 dated Dec. 28, 2020 (8 pages).
Office Action for related Korean Application No. 10-2019-7038709 dated Jul. 26, 2021 (10 pages).

* cited by examiner

*Primary Examiner* — Scott R Kastler
(74) *Attorney, Agent, or Firm* — Procopio, Cory, Hargreaves & Savitch LLP

(57) ABSTRACT

A low-cost and high-formability 1180 MPa grade cold-rolled annealed dual-phase steel plate and a manufacturing method thereof are provided. The dual-phase steel plate has the following chemical composition by mass percentages: C: 0.1%-0.125%, Si: 0.4%-0.8%, Mn: 2.6%-2.9%, Al: 0.01%-0.05%, Nb: 0.01%-0.03%, and Ti: 0.01%-0.03%, the remainder being Fe and unavoidable impurities. By reasonable design of alloy elements and manufacturing processes, the dual-phase steel plate of the invention achieves a strength of 1180 MPa grade at a low cost, obtains a fine and uniform martensite-ferrite dual-phase structure that ensures excellent elongation rate and cold bending performance, and has good formability. The dual-phase steel plate has a yield strength of more than 850 MPa, a tensile strength of more than 1180 MPa, an elongation rate of 8% or more, and a parameter (R/t), characterizing the 90-degree cold bending performance, of 2.5 or less.

11 Claims, No Drawings

LOW-COST AND HIGH-FORMABILITY 1180 MPA GRADE COLD-ROLLED ANNEALED DUAL-PHASE STEEL PLATE AND MANUFACTURING METHOD THEREOF

CROSS-REFERENCE TO RELATED APPLICATIONS

This application is a U.S. National Stage entry of PCT Application No: PCT/CN2018/092876 filed Jun. 26, 2018, which claims priority to Chinese Patent Application No. 201710520183.3, filed Jun. 30, 2017, the contents of which are incorporated herein by reference.

TECHNICAL FIELD

The invention relates to a dual-phase steel plate and a manufacturing method thereof, in particular to a low-cost and high-formability 1180 MPa grade cold-rolled annealed double-phase steel plate and a manufacturing method thereof. The steel plate has a yield strength of 850 MPa or more, a tensile strength of 1180 MPa or more, excellent formability, and particularly excellent cold bending performance.

BACKGROUND ART

As the global energy crisis and environmental problems intensify, energy conservation and safety have become the main development direction of the automobile industry. Reducing vehicle weight is one of the measures to save energy and reduce emissions. High-strength dual-phase steel has good mechanical properties and usability, and is therefore suitable for the manufacture of structural parts.

As the market changes, the requirements for lower cost and better performances become more and more prominent. At present, the 780DP and 980DP are mainly used, and the 1180DP is often used for simple formed structural parts due to its poor formability. As the trend towards weight reduction and energy conservation continues to evolve, the center strength level of double-phase steels is expected to increase in the future. Accordingly, the demand for 1180DP will increase, provided that the 1180DP has comparable elongation rate and bending performance to 980DP.

The existing cold rolled double-phase steel having ultra-high strength is as described in Chinese Patent No. CN102227511B. CN102227511B discloses a high-strength cold-rolled steel sheet and a high-strength hot-dip galvanized steel sheet having a TS of 1180 MPa or more and excellent in formability such as hole expansion ratio and bendability, and a method for producing the same. The high-strength cold-rolled steel sheet or the high-strength hot-dip galvanized steel sheet contains 0.05% to 0.3% C, 0.5% to 2.5% Si, 1.5% to 3.5% Mn, 0.001% to 0.05% P, 0.0001% to 0.01% S, 0.001% to 0.1% Al, 0.0005% to 0.01% N, and 1.5% or less Cr (including 0%); and contains a ferritic phase and a martensitic phase, the area fraction of the martensitic phase in the total microstructure being 30% or more, the quotient (the area occupied by the martensitic phase)/(the area occupied by the ferritic phase) being more than 0.45 to less than 1.5. Its uniqueness lies in that better formability is obtained by a high proportion of ferrite content.

Chinese Application Publication No. CN105829564A provides a high-strength steel sheet suitable for use in a slab for automotive parts and a method for manufacturing the same. The high-strength steel sheet has excellent spot weldability, excellent ductility, and excellent bending workability while maintaining a YS of 780 MPa or more and a TS of 1180 MPa or more. The high-strength steel sheet includes the following composition: C: 0.05% to 0.15%, Si: 0.01% to 1.00%, Mn: 1.5% to 4.0%, P: 0.100% or less, S: 0.02% or less, Al: 0.01% to 0.50%, Nb: 0.005% to 0.100%, Ti: 0.005% to 0.100%, Cr: 0.010% to 2.000%, B: 0.0005% to 0.0050%, wherein the average crystal grain size of ferrite and martensite is 10 μm or less. Its uniqueness lies in that it refines grains and improves hardenability by adding B element and the corresponding processes, and improves hardenability by adding Cr.

Chinese Application Publication No. CN102828106A discloses a high-strength steel sheet having a tensile strength of 1180 MPa or more and exhibiting satisfactory workability and good resistance to cold brittleness. The high-strength steel sheet contains carbon (C) in a content of from 0.10% to 0.30%, silicon (Si) in a content of from 1.40% to 3.0%, manganese (Mn) in a content of from 0.5% to 3.0%, phosphorus (P) in a content of 0.1% or less, sulfur (S) in a content of 0.05% or less, aluminum (Al) in a content of from 0.005% to 0.20%, nitrogen (N) in a content of 0.01% or less, and oxygen (O) in a content of 0.01% or less, with the remainder including iron (Fe) and inevitable impurities. In the steel sheet, the volume fraction of a mixed structure (MA constituent) of fresh martensite and retained austenite is 6% or less (excluding 0%) based on the total volume of structures, and when measuring retained austenite by X-ray diffraction, the volume fraction of retained austenite is 5% or more based on the total volume of structures. Its uniqueness lies in that by adding 1.40 to 3.0% of Si, retained austenite is obtained in the final structure, and the molding property is improved.

Chinese Application Publication No. CN106661701A discloses a method for producing a high strength steel sheet having a yield strength YS of more than 850 MPa, a tensile strength TS of more than 1180 MPa, a total elongation rate of more than 13% and a hole expansion ratio HER of more than 30%, by heat treating a steel sheet comprising the following chemical composition: 0.13%≤C≤0.22%, 1.2%≤Si≤1.8%, 1.8%≤Mn≤2.2%, 0.10%≤Mo≤0.20%, Nb≤0.05%, Ti≤0.05%, Al≤0.5%, the remainder being Fe and unavoidable impurities. The final structure of the steel comprises 3-15% of residual austenite. Its uniqueness lies in that by adding Si in the range of 1.2%~1.8%, residual austenite is obtained in the final structure, and the molding property is improved.

Chinese Application Publication No. CN106661653A discloses a method for manufacturing a steel sheet having a yield strength YS of more than 1000 MPa, a tensile strength TS of more than 1150 MPa and a total elongation rate E of more than 8%, the method comprising the steps of: preparing a steel sheet through rolling a steel containing in percent by weight 0.19% to 0.22% C, 2% to 2.6% Mn, 1.45% to 1.55% Si, 0.15% to 0.4% Cr, less than 0.020% P, less than 0.05% S, less than 0.08% N, 0.015% to 0.070% Al, heating the steel sheet to a first overaging temperature TOA1 higher than 380° C. during a period of 115 s~240 s, then heating the sheet to a second overaging temperature TOA2 between 420° and 450° C. during a period of 300 s~610 s, and cooling the steel sheet to a temperature less than 100° C. at a cooling speed less than 5° C./s. The steel sheet has a structure containing more than 80% of tempered martensite, more than 5% of retained austenite. Its uniqueness lies in that it uses a high C content of 0.19% to 0.22%, a Si content of 1.45% to 1.55%, and a unique two-aging process to obtain a retained austenite plus martensite structure, ensuring high strength and high formability.

SUMMARY OF THE INVENTION

It is an object of the present invention to provide a low-cost and high-formability 1180 MPa grade cold-rolled annealed dual-phase steel plate and a manufacturing method thereof. By reasonable design of alloy elements and manufacturing processes, the steel plate achieves a strength of 1180 MPa grade at a low cost, obtains a fine and uniform martensite-ferrite dual-phase structure that ensures excellent elongation rate and cold bending performance, and has good formability. The dual-phase steel plate has a yield strength of more than 850 MPa, a tensile strength of more than 1180 MPa, an elongation rate of 8% or more, and a parameter (R/t), characterizing the 90° cold bending performance, of 2.5 or less, wherein R is the bend radius and t is the plate thickness in mm.

In order to achieve the above technical purpose, the present invention uses the following technical solutions:

The steel composition according to the invention is designed to be a C- and Mn-based system to ensure a strength of 1180 MPa grade. No precious alloying elements such as Mo and Cr are added to the steel to ensure low cost. A trace amount of Nb and Ti are added to the steel to achieve an effect of suppressing austenite grain growth, thereby effectively refining crystal grains. The special component design without adding Mo and Cr and the special hot-rolling low-temperature coiling process ensure that the hot-rolled steel coil has a tensile strength of less than 1000 MPa, and the manufacturability by cold rolling.

In the manufacturing process of the present invention, since the microalloying elements Cr and Mo are not added, which is disadvantageous for refining crystal grains, the following special coiling temperature in hot rolling is adopted: in the hot rolling process, low temperature coiling (400-500° C.) is performed in the bainite transformation zone to ensure that the hot-rolled structure has a bainite content of 80% or more; after coiling, it is cooled to a temperature of 370° C. or less at a cooling rate of not more than 0.3° C./s, and does not enter the martensite transformation zone, to ensure that the hot rolling strength meets the requirements of cold rolling manufacturability. Through the above process, the cold-rolled structure is a uniform deformed bainite structure having a large number of defects such as dislocations, which provides a large number of nucleation points of austenite, so that the nucleation of austenite is explosive, and the austenite grains are remarkably refined. Moreover, these defects become channels for high-speed diffusion of carbon atoms. Because the entire matrix structure is uniform and the carbon concentration difference is small, the austenite is rapidly formed, and the volume fraction of austenite is increased to obtain a fine and uniform final structure.

Specifically, the present invention provides a low-cost and high-formability 1180 MPa grade cold-rolled annealed dual-phase steel plate, comprising the following chemical composition by mass percentages: C: 0.1%-0.125%, Si: 0.4%-0.8%, Mn: 2.6%-2.9%, Al: 0.01%-0.05%, Nb: 0.01%-0.03%, and Ti: 0.01%-0.03%, the remainder being Fe and unavoidable impurities.

The dual-phase steel plate according to the present invention has a fine and uniform martensite-ferrite dual-phase structure, wherein the dual-phase steel plate contains at least 75% of martensite, and the rest is ferrite; the grain size of the martensite is not more than 5 micrometers, and the grain size of the ferrite is not more than 5 micrometers.

The dual-phase steel plate has a yield strength of more than 850 MPa, a tensile strength of more than 1180 MPa, an elongation rate of 8% or more, and a parameter (R/t), characterizing the 90° cold bending performance, of 2.5 or less, wherein R is the bend radius and t is the plate thickness in mm.

In the design of the dual-phase steel plate of the present invention, the principle of addition of each element is as follows.

Carbon: In the dual-phase steel plate according to the present invention, the addition of the C element serves to increase the strength of the steel and increase the hardness of the martensite. Therefore, the mass percentage of C is selected to be between 0.1% and 0.125% because when the mass percentage of C is less than 0.1%, the strength of the steel sheet is affected, and it is disadvantageous to the formation amount and stability of austenite; and when the mass percentage of C is higher than 0.125%, the hardness of martensite is too high, and the grain size is coarse, and it is disadvantageous for the formability of the steel plate. Therefore, the mass percentage of C is preferably from 0.11% to 0.125%.

Silicon: The addition of Si can improve hardenability. Moreover, the solid solution of Si in the steel can affect the interaction of dislocations, increase the work hardening rate, and appropriately increase the elongation rate of the dual-phase steel, which is advantageous for obtaining good formability. Therefore, the Si content is controlled to 0.4% to 0.8%, preferably 0.5% to 0.7%.

Manganese: The addition of Mn element is beneficial to improve the hardenability of steel and effectively increase the strength of steel plate. The mass percentage of Mn is selected to be 2.6% to 2.9% because when the mass percentage of Mn is less than 2.6%, the strength of the steel sheet is insufficient; and when the mass percentage of Mn is higher than 2.9%, the strength of the steel plate is too high, resulting in a decrease in formability and segregation is liable to occur. Therefore, in the low-cost and high-formability 1180 MPa grade cold-rolled annealed dual-phase steel plate according to the present invention, the mass percentage of Mn is 2.6% to 2.9%, preferably 2.7% to 2.85%.

Aluminum: The addition of Al has the effects of deoxidizing and refining crystal grains. Therefore, the mass percentage of Al is controlled to 0.01% to 0.05%, preferably 0.015% to 0.045%.

Niobium: 0.01% to 0.03% of Nb is added because: after adding a small amount of strong carbide forming element Nb to the microalloyed steel, during the controlled rolling process, the strain-induced precipitation phase significantly reduces the recrystallization temperature of the deformed austenite by particle pinning and subgrain boundary, and provides nucleation particles, which has a significant effect on the grain refinement. During the continuous annealing austenitization process, the soaked undissolved carbide and nitride particles prevent the coarsening of the soaked austenite grains by pinning the grain boundaries through the particles, and thus effectively refine the grains. Therefore, the amount of Nb is preferably 0.015% to 0.025%.

Titanium: 0.01% to 0.03% of Ti is added because the strong carbide forming element Ti strongly suppresses the growth of austenite grains at a high temperature while effectively refining crystal grains. Therefore, Ti is preferably controlled to 0.015% to 0.025%.

Chromium and molybdenum: The reasons for not adding Cr and Mo are as follows. First, the cost of steel can be reduced without adding Cr and Mo. Second, the present invention employs a unique grain refining process: low temperature coiling in the bainite transformation zone in the hot rolling process. The process is designed in accordance with a system without Cr and Mo components, so as to ensure that the tensile strength of the hot coil is less than 1000 MPa and the manufacturability by cold rolling. In the present invention, the effect of Cr and Mo in refining crystal grains and improving the strength of material is achieved by rational design of the composition and process, and the cost is lowered.

In the technical solutions of the present invention, unavoidable impurity elements include P, N, and S. The lower the impurity content, the better the effect. The mass percentage of P is controlled to 0.015% or less. The MnS formed by S seriously affects the formability, and thus the mass percentage of S is controlled to 0.003% or less. Since N easily causes cracks or bubbles on the surface of the slab, N is 0.005% or less.

In the above composition design, precious alloying elements such as Mo and Cr are not added to ensure low cost. Meanwhile, in order to secure a tensile strength of 1180 MPa grade when cooling with gas at a cooling rate of 30-100° C./s during normal continuous annealing, it is necessary to ensure an alloy addition amount of C and Mn to provide sufficient hardenability. However, the content of C and Mn alloy elements needs to set an upper limit to ensure excellent weldability and formability, and to avoid strength exceeding the upper limit. The upper limit of the strength of 1180 MPa grade high-strength steel with high formability is different in various standards. The common standard is 1350 MPa, and a stricter standard is 1300 MPa. If the strength exceeds the upper limit, the formability will be degraded. The addition of trace amounts of Nb and Ti suppresses the growth of austenite grains and effectively refines the grains.

In addition, in order not to enter the ferrite transformation zone during cooling into the bainite phase transition zone in the hot rolling process, ensuring the bainite content of the hot rolled structure to be 80% or more, it is necessary to control the ratio of the C content and the Mn content. In the phase diagram of the component system of the present invention, when the C content is increased, the ferrite transformation zone is shifted to the right, and when the C content is decreased, the ferrite transformation zone is shifted to the left; when the Mn content is increased, the bainite transformation is shifted upward, and when the Mn content is decreased, the bainite transformation is shifted downward. Therefore, when the C content is high, the content of Mn can be controlled to decrease toward the lower limit; when the C content is low, the content of Mn can be controlled to increase toward the upper limit. The addition of Si also shifts the ferrite phase transition zone to the right, but the effect is inferior to the addition of the same amount of C. Therefore, the C, Mn and Si contents in the present invention should satisfy the following formula: $1.73\times[C]\times[Mn]+[Si]\geq 1$.

Due to the competitive precipitation between the nitrides of Al and the carbonitrides of Nb and Ti during steel production, it is necessary to ensure a certain addition amount of Nb and Ti in order to refine the grain, based on the contents of Al and N in the component system of the present invention. Therefore, the Nb and Ti contents in the present invention should satisfy the following formula: $[Nb]+[Ti]\times 3\geq 0.047$.

The method for manufacturing a low-cost and high-formability 1180 MPa grade cold-rolled annealed dual-phase steel plate according to the present invention comprises the steps of:

1) smelting and casting: smelting and casting into a slab based on the above composition;

2) hot rolling: firstly, heating to 1100-1230° C. and holding for 0.6 hours or more, and then hot rolling at a temperature of Ar3 or more, after rolling, rapidly cooling at a rate of 30-100° C./s; coiling at a temperature of 400-500° C., after coiling, slowly cooling to 370° C. or less at a cooling rate of not more than 0.3° C./s;

3) cold rolling: the cold rolling is controlled at a reduction rate of 50-70%;

4) annealing: annealing at a soaking temperature of 790-840° C., preferably 800-820° C.; then cooling at a rate of v=3-20° C./s to the rapid cooling start temperature T, wherein the rapid cold start temperature $T\geq 800-30\times v$, and then cooling to 200-270° C. at a rate of 30-100° C./s;

5) tempering: tempering at a temperature of 200-270° C. for 100-400 s;

6) leveling: leveling to a degree of 0-0.3%.

In the method for manufacturing a low-cost and high-formability 1180 MPa grade cold-rolled annealed dual-phase steel plate according to the present invention, in the hot rolling step, firstly, heating to 1100-1230° C. and holding for 0.6 hours or more, and then hot rolling at a temperature of Ar3 or more; after rolling, rapidly cooling at a rate of 30-100° C./s. A special coiling temperature is used: in the hot rolling process, low temperature coiling (400-500° C.) is performed in the bainite transformation zone to ensure that the hot-rolled structure has a bainite content of 80% or more. After coiling, it is cooled to 370° C. or less at a cooling rate of not more than 0.3° C./s, and does not enter the martensite transformation zone, to ensure that the hot rolling strength meets the requirements of cold rolling manufacturability.

In the annealing step, the soaking temperature is limited to 790-840° C. When the annealing temperature is within the above range, a tensile strength of 1180 MPa can be obtained while ensuring fine grain size, thereby obtaining a better formability. When the soaking temperature during annealing is lower than 790° C., a tensile strength of 1180 MPa cannot be obtained. When the soaking temperature during annealing is higher than 840° C., the grain size is coarse and the formability is greatly reduced.

By comprehensively comparing the structures formed by each components at the same soaking temperature, it can be seen that when the soaking temperature is 800-820° C. and the C content is 0.11-0.125%, finer crystal grains, moderate mechanical properties, and superior formability can be obtained. Fine grains help to ensure good elongation rate and bending properties. Therefore, the preferred C content ranges from 0.11 to 0.125%, and the preferred process window of the soaking temperature during continuous annealing is 800-820° C.

Compared with the prior art, the present invention obtains a steel plate having a tensile strength of more than 1180 MPa and a fine and uniform martensite-ferrite dual-phase structure by rational design of the alloy composition and process, without the addition of Mo and Cr. The steel plate of the present invention has good elongation rate and cold bending properties while ensuring high strength. The steel plate of the present invention has a yield strength of more than 850 MPa, a tensile strength of more than 1180 MPa, an elongation rate of 8% or more, and a parameter (R/t), characterizing the 90° cold bending performance, of 2.5 or less, wherein R is the bend radius and t is the plate thickness in mm.

Accordingly, the manufacturing method of the present invention obtains a high-formability and high-strength cold-rolled dual-phase steel plate having a tensile strength of more than 1180 MPa, a low manufacturing cost, a high elongation rate, and a good cold bending property by designing alloy compositions and specific process parameters.

DETAILED DESCRIPTION

The invention will be further explained and illustrated in conjunction with the specific Examples. However, the explanations and illustrations are not intended to unduly limit the technical solutions of the present invention.

The compositions of the steel of the Examples of the present invention are shown in Table 1, and the balance in the steel is Fe. Table 2 lists the process parameters of the steel plates of the Examples. Table 3 lists the performance parameters of the steel plates of the Examples.

The method for manufacturing the steel of the Examples of the present invention is as follows:

(1) smelting and casting: obtaining a slab with required alloy composition and minimize the contents of S and P.

2) hot rolling: firstly, heating to 1100-1230° C. and holding for 0.6 hours or more, and then hot rolling at a temperature of Ar3 or more, after rolling, rapidly cooling at a rate of 30-100° C./s; in the hot rolling process, low temperature coiling (400-500° C.) is performed in the bainite transformation zone to ensure that the final hot-rolled structure has a bainite content of 80% or more; after coiling, it is cooled to a temperature of 370° C. or less at a cooling rate of not more than 0.3° C./s, and does not enter the martensite transformation zone, to ensure that the hot rolling strength meets the requirements of cold rolling manufacturability;

3) cold rolling: the cold rolling is controlled at a reduction rate of 50-70%;

4) annealing: annealing at a soaking temperature of 790-840° C., preferably 800-820° C.; then cooling at a rate of v=3-20° C./s to the rapid cooling start temperature T, wherein the rapid cold start temperature T≥800−30×v, and then cooling to 200-270° C. at a rate of 30-100° C./s;

5) tempering: tempering at a temperature of 200-270° C. for 100-400 s;

6) leveling: leveling to a degree of 0-0.3%.

Table 3 shows the mechanical properties of Examples 1-18 (i.e., low-cost and high-formability 1180 MPa grade cold-rolled annealed dual-phase steel plates obtained according to the compositions and processes of the present invention). The steel plate of the present invention has a yield strength of more than 850 MPa, a tensile strength of more than 1180 MPa, an elongation rate of 8% or more, and a parameter (R/t), characterizing the 90° cold bending performance, of 2.5 or less. It can be seen that the low-cost and high-formability 1180 MPa grade cold-rolled annealed dual-phase steel plate according to the present invention achieves a tensile strength of more than 1180 MPa, a good elongation rate, and excellent cold bending property without adding precious alloying elements such as Mo and Cr.

TABLE 1

Unit: mass percentage

| Number | C | Si | Mn | Al | P | S | N | Nb | Ti |
|---|---|---|---|---|---|---|---|---|---|
| Example 1 | 0.101 | 0.562 | 2.817 | 0.032 | 0.013 | 0.0016 | 0.0035 | 0.023 | 0.021 |
| Example 2 | 0.101 | 0.562 | 2.817 | 0.032 | 0.013 | 0.0016 | 0.0035 | 0.023 | 0.021 |
| Example 3 | 0.101 | 0.562 | 2.817 | 0.032 | 0.013 | 0.0016 | 0.0035 | 0.023 | 0.021 |
| Example 4 | 0.102 | 0.56 | 2.740 | 0.028 | 0.011 | 0.0020 | 0.0045 | 0.021 | 0.021 |
| Example 5 | 0.102 | 0.56 | 2.740 | 0.028 | 0.011 | 0.0020 | 0.0045 | 0.021 | 0.021 |
| Example 6 | 0.102 | 0.56 | 2.740 | 0.028 | 0.011 | 0.0020 | 0.0045 | 0.021 | 0.021 |
| Example 7 | 0.110 | 0.63 | 2.760 | 0.045 | 0.009 | 0.0022 | 0.0037 | 0.025 | 0.021 |
| Example 8 | 0.110 | 0.63 | 2.760 | 0.045 | 0.009 | 0.0022 | 0.0037 | 0.025 | 0.021 |
| Example 9 | 0.110 | 0.63 | 2.760 | 0.045 | 0.009 | 0.0022 | 0.0037 | 0.025 | 0.021 |
| Example 10 | 0.120 | 0.63 | 2.760 | 0.038 | 0.011 | 0.0015 | 0.0031 | 0.026 | 0.021 |
| Example 11 | 0.120 | 0.63 | 2.760 | 0.038 | 0.011 | 0.0015 | 0.0031 | 0.026 | 0.021 |
| Example 12 | 0.120 | 0.63 | 2.760 | 0.038 | 0.011 | 0.0015 | 0.0031 | 0.026 | 0.021 |
| Example 13 | 0.124 | 0.57 | 2.80 | 0.026 | 0.008 | 0.0012 | 0.0043 | 0.023 | 0.021 |
| Example 14 | 0.124 | 0.57 | 2.80 | 0.026 | 0.008 | 0.0012 | 0.0043 | 0.023 | 0.021 |
| Example 15 | 0.124 | 0.57 | 2.80 | 0.026 | 0.008 | 0.0012 | 0.0043 | 0.023 | 0.021 |
| Example 16 | 0.115 | 0.65 | 2.68 | 0.033 | 0.013 | 0.0010 | 0.0035 | 0.021 | 0.023 |
| Example 17 | 0.115 | 0.65 | 2.68 | 0.033 | 0.013 | 0.0010 | 0.0035 | 0.021 | 0.023 |
| Example 18 | 0.115 | 0.65 | 2.68 | 0.033 | 0.013 | 0.0010 | 0.0035 | 0.021 | 0.023 |

TABLE 2

| | Hot rolling | | | | | | Cold rolling | Annealing | | | | Rapid cooling | Tempering | |
|---|---|---|---|---|---|---|---|---|---|---|---|---|---|---|
| Number | Heating temperature (° C.) | Holding time (h) | Hot rolling temperature (° C.) | Cooling rate (° C./s) | Coiling temperature (° C.) | Cooling rate after coiling (cooling to 370° C.) (° C./s) | Cold rolling reduction rate (%) | Annealing temperature (° C.) | v1 (° C./s) | Rapid cooling start temperature T (° C.) | Rapid cooling rate (° C./s) | termination temperature (° C.) | Tempering temperature (° C.) | Tempering time (s) |
| Example 1 | 1230 | 1 | 880 | 50 | 450 | 0.3 | 60 | 800 | 5 | 670 | 50 | 240 | 240 | 200 |
| Example 2 | 1230 | 1 | 880 | 50 | 450 | 0.3 | 60 | 820 | 5 | 670 | 50 | 240 | 240 | 200 |
| Example 3 | 1230 | 1 | 880 | 50 | 450 | 0.3 | 60 | 840 | 5 | 670 | 50 | 240 | 240 | 200 |
| Example 4 | 1230 | 1 | 880 | 50 | 450 | 0.3 | 60 | 800 | 5 | 670 | 50 | 240 | 240 | 200 |

TABLE 2-continued

| Number | Hot rolling: Heating temperature (° C.) | Hot rolling: Holding time (h) | Hot rolling: Hot rolling temperature (° C.) | Hot rolling: Cooling rate (° C./s) | Hot rolling: Coiling temperature (° C.) | Hot rolling: Cooling rate after coiling (cooling to 370° C.) (° C./s) | Cold rolling: Cold rolling reduction rate (%) | Annealing: Annealing temperature (° C.) | Annealing: v1 (° C./s) | Annealing: Rapid cooling start temperature T (° C.) | Annealing: Rapid cooling rate (° C./s) | Annealing: Rapid cooling termination temperature (° C.) | Tempering: Tempering temperature (° C.) | Tempering: Tempering time (s) |
|---|---|---|---|---|---|---|---|---|---|---|---|---|---|---|
| Example 5 | 1230 | 1 | 880 | 50 | 450 | 0.3 | 60 | 820 | 5 | 670 | 50 | 240 | 240 | 200 |
| Example 6 | 1230 | 1 | 880 | 50 | 450 | 0.3 | 60 | 840 | 5 | 670 | 50 | 240 | 240 | 200 |
| Example 7 | 1230 | 1 | 880 | 50 | 450 | 0.3 | 60 | 800 | 5 | 670 | 50 | 240 | 240 | 200 |
| Example 8 | 1230 | 1 | 880 | 50 | 450 | 0.3 | 60 | 820 | 5 | 670 | 50 | 240 | 240 | 200 |
| Example 9 | 1230 | 1 | 880 | 50 | 450 | 0.3 | 60 | 840 | 5 | 670 | 50 | 240 | 240 | 200 |
| Example 10 | 1230 | 1 | 880 | 50 | 450 | 0.3 | 60 | 800 | 5 | 670 | 50 | 240 | 240 | 200 |
| Example 11 | 1230 | 1 | 880 | 50 | 450 | 0.3 | 60 | 820 | 5 | 670 | 50 | 240 | 240 | 200 |
| Example 12 | 1230 | 1 | 880 | 50 | 450 | 0.3 | 60 | 840 | 5 | 670 | 50 | 240 | 240 | 200 |
| Example 13 | 1230 | 1 | 880 | 50 | 450 | 0.3 | 60 | 800 | 5 | 670 | 50 | 240 | 240 | 200 |
| Example 14 | 1230 | 1 | 880 | 50 | 450 | 0.3 | 60 | 820 | 5 | 670 | 50 | 240 | 240 | 200 |
| Example 15 | 1230 | 1 | 880 | 50 | 450 | 0.3 | 60 | 840 | 5 | 670 | 50 | 240 | 240 | 200 |
| Example 16 | 1150 | 0.6 | 880 | 40 | 400 | 0.2 | 70 | 810 | 5 | 650 | 40 | 220 | 220 | 250 |
| Example 17 | 1200 | 1 | 890 | 50 | 460 | 0.25 | 60 | 810 | 10 | 670 | 60 | 240 | 240 | 200 |
| Example 18 | 1250 | 1.5 | 900 | 60 | 500 | 0.3 | 50 | 810 | 15 | 690 | 80 | 260 | 260 | 150 |

TABLE 3

| Number | Yield strength (MPa) | Tensile strength (MPa) | Elongation rate (%) | 90° bending radius R (mm) | Plate thickness t (mm) | R/t |
|---|---|---|---|---|---|---|
| Example 1 | 858 | 1180 | 9.3 | 2.0 | 1.1 | 1.8 |
| Example 2 | 855 | 1183 | 8.6 | 2.0 | 1.1 | 1.8 |
| Example 3 | 874 | 1196 | 8.2 | 2.0 | 1.1 | 1.8 |
| Example 4 | 901 | 1197 | 8.6 | 2.0 | 1.2 | 1.7 |
| Example 5 | 954 | 1225 | 8.3 | 2.0 | 1.2 | 1.7 |
| Example 6 | 913 | 1217 | 8.2 | 2.0 | 1.2 | 1.7 |
| Example 7 | 855 | 1288 | 9.1 | 2.0 | 1.1 | 1.9 |
| Example 8 | 902 | 1191 | 8.4 | 2.0 | 1.0 | 2 |
| Example 9 | 886 | 1231 | 8.2 | 2.0 | 1.0 | 2 |
| Example 10 | 853 | 1242 | 10.3 | 2.0 | 1.0 | 2 |
| Example 11 | 858 | 1228 | 8.4 | 2.0 | 1.1 | 1.9 |
| Example 12 | 931 | 1258 | 8.6 | 2.0 | 1.0 | 2 |
| Example 13 | 894 | 1278 | 9.4 | 2.0 | 1.1 | 1.8 |
| Example 14 | 882 | 1269 | 8.6 | 2.0 | 1.1 | 1.8 |
| Example 15 | 1021 | 1324 | 8.5 | 2.0 | 1.3 | 1.6 |
| Example 16 | 874 | 1232 | 9.0 | 2.0 | 1.0 | 2 |
| Example 17 | 883 | 1223 | 9.1 | 2.0 | 1.0 | 2 |
| Example 18 | 867 | 1234 | 8.7 | 2.0 | 1.0 | 2 |

The invention claimed is:

1. A 1180 MPa grade cold-rolled annealed dual-phase steel plate, consisting of following chemical composition by mass percentages:

C: 0.1%-0.125%,

Si: 0.4%-0.8%,

Mn: 2.6%-2.9%,

Al: 0.01%-0.05%,

Nb: 0.01%-0.03%, and

Ti: 0.01%-0.03%, a remainder being Fe and unavoidable impurities, wherein C, Mn and Si contents satisfy that $1.73\times[C]\times[Mn]+[Si]\geq 1$, and Nb and Ti contents satisfy that $[Nb]+[Ti]\times 3\geq 0.047$.

2. The 1180 MPa grade cold-rolled annealed dual-phase steel plate as claimed in claim 1, wherein the C content is from 0.11% to 0.125%.

3. The 1180 MPa grade cold-rolled annealed dual-phase steel plate as claimed in claim 1, wherein the Si content is from 0.5% to 0.7%.

4. The 1180 MPa grade cold-rolled annealed dual-phase steel plate as claimed in claim 1, wherein the Mn content is from 2.7% to 2.85%.

5. The 1180 MPa grade cold-rolled annealed dual-phase steel plate as claimed in claim 1, wherein the Al content is from 0.015% to 0.045%.

6. The 1180 MPa grade cold-rolled annealed dual-phase steel plate as claimed in claim 1, wherein the Nb content is from 0.015% to 0.025%.

7. The 1180 MPa grade cold-rolled annealed dual-phase steel plate as claimed in claim 1, wherein the Ti content is from 0.015% to 0.025%.

8. The 1180 MPa grade cold-rolled annealed dual-phase steel plate as claimed in claim 1, wherein the dual-phase steel plate has a fine and uniform martensite-ferrite dual-phase structure, and wherein the dual-phase steel plate contains at least 75% of martensite, and a rest is ferrite the martensite has a grain size of not more than 5 micrometers, and the ferrite has a grain size of not more than 5 micrometers.

9. The 1180 MPa grade cold-rolled annealed dual-phase steel plate as claimed in claim 1, wherein the dual-phase steel plate has a yield strength of more than 850 MPa, a tensile strength of more than 1180 MPa, an elongation rate of 8% or more, and a parameter (R/t), characterizing 90° cold bending performance, of 2.5 or less, wherein R is bend radius, and t is plate thickness in mm.

10. A method for manufacturing the 1180 MPa grade cold-rolled annealed dual-phase steel plate as claimed in claim 1, wherein the method comprises:

1) smelting and casting into a slab having a chemical composition claimed in claim 1;
2) hot rolling including firstly, heating to 1100° C.-1230° C. and holding for 0.6 hours or more, and then hot rolling at a temperature of Ar3 or more, after rolling, rapidly cooling at a rate of 30° C./s-100° C./s coiling at a temperature of 400° C.-500° C., after coiling, slowly cooling to 370° C. or less at a cooling rate of not more than 0.3° C./s;
3) cold rolling that is controlled at a reduction rate of 50%-70%;
4) annealing at a soaking temperature of 790° C.-840° C., then cooling at a rate of v=3° C./s-20° C./s to a rapid cooling start temperature T, wherein the rapid cold start temperature satisfies T≥800-30×v, and then cooling to 200° C.-270° C. at a rate of 30° C./s-100° C./s;
5) tempering at a temperature of 200° C.-270° C. for 100 s-400 s; and
6) leveling to a degree of 0%-0.3%.

11. A 1180 MPa grade cold-rolled annealed dual-phase steel plate, comprising following chemical composition by mass percentages:

C: 0.1%-0.125%,
Si: 0.4%-0.8%,
Mn: 2.6%-2.9%,
Al: 0.01%-0.05%,
Nb: 0.01%-0.03%, and
Ti: 0.01%-0.03%,
a remainder being Fe and unavoidable impurities,
wherein C, Mn and Si contents satisfy that 1.73×[C]×[Mn]+[Si]≥1, and Nb and Ti contents satisfy that [Nb]+[Ti]×3≥0.047, and
wherein the steel plate does not contain Mo and does not contain Cr.

* * * * *